US007074034B2

(12) United States Patent
Hoke, Jr. et al.

(10) Patent No.: US 7,074,034 B2
(45) Date of Patent: Jul. 11, 2006

(54) BURNER AND PROCESS FOR COMBUSTION OF A GAS CAPABLE OF REACTING TO FORM SOLID PRODUCTS

(75) Inventors: Bryan Clair Hoke, Jr., Bethlehem, PA (US); Aleksandar Georgi Slavejkov, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 136 days.

(21) Appl. No.: 10/862,851

(22) Filed: Jun. 7, 2004

(65) Prior Publication Data

US 2005/0287487 A1 Dec. 29, 2005

(51) Int. Cl.
*F23D 14/00* (2006.01)
*F23C 7/00* (2006.01)

(52) U.S. Cl. ..... 431/10; 431/187

(58) Field of Classification Search ..... 431/5, 431/10, 183, 187, 243, 353
See application file for complete search history.

(56) References Cited

U.S. PATENT DOCUMENTS

| | | | | |
|---|---|---|---|---|
| 4,347,052 | A * | 8/1982 | Reed et al. | 431/188 |
| 4,801,437 | A | 1/1989 | Konagaya et al. | |
| 5,123,836 | A | 6/1992 | Yoneda et al. | |
| 5,957,678 | A | 9/1999 | Endoh et al. | |

* cited by examiner

*Primary Examiner*—Alfred Basichas
(74) *Attorney, Agent, or Firm*—Bryan C. Hoke, Jr.

(57) ABSTRACT

This invention is a directed to combustion apparatus incorporating a combustion chamber, a precombustion chamber and a multi-wall burner and a process for effecting combustion of gases, particularly feed gases containing gases that, on combustion, form solid oxidation products, i.e., solid-forming gases. A pathway is formed between the exterior of the precombustion chamber and the interior of said combustion chamber, whereby said pathway permits introduction of a secondary oxidant into the interior portion of the combustion chamber for facilitating combustion of said solid forming gas.

23 Claims, 5 Drawing Sheets

BURNER AND PROCESS FOR COMBUSTION OF A GAS CAPABLE OF REACTING TO FORM SOLID PRODUCTS

BACKGROUND OF THE INVENTION

The disposal of residual gases generated in industrial processes by means of combustion is well known. In the electronics and semiconductor industries, for example, a waste gas typically containing low concentrations of gaseous toxic substances represented by arsine ($AsH_3$), phosphine ($PH_3$), diborane ($B_2H_6$), silane ($SiH_4$), etc. is formed in the steps for manufacturing semi-conductors. Since this waste gas is highly toxic, complete elimination of such toxic substances contained in the waste gas is necessary prior to exhausting of the waste gas into the atmosphere.

Another source of residual, and often toxic, gases arises from the refilling of cylinders employed for providing such source gases to various industries. Spent cylinders previously used in an electronics processing facility containing residual gases, for example, are returned to a transfill facility. Before such cylinders are refilled, they are generally purged and/or evacuated to remove all contaminants, generating a cylinder purge gas often having a high concentration of toxic gas. These cylinder purge gases must also be treated prior to discharge to the atmosphere.

Various methods are known for effectively eliminating such toxic gases and these methods include combustion. The combustion methods contemplate oxidative decomposition of the toxic substances in the residual, waste gas under combustion conditions whereby the gaseous toxic substances are oxidatively converted into less reactive, often innocuous, reaction products including solid oxides.

A major problem in the combustion of flammable, and often toxic gases, which generate solid phase oxidation products is one of nozzle plugging and particle build-up in the combustion chamber. Recirculation of the solid phase products in the combustion process often leads to significant deposition of finely divided particles on the burner nozzles thus interfering with combustion. Build-up of the particles can lead to aggregation and potential for incomplete combustion of the residual gases. Intermediate products of incomplete combustion can burn in a downstream part of the process that can sometimes lead to safety issues (e.g., burning holes in filter bags). Complete plugging of the burner nozzles can lead to a pressure increase in the system creating safety issues.

The following references illustrate various combustion processes for the disposal of combustible and often toxic feed gases that form solid phase oxidation products many of which are commonly used in the electronics industry:

U.S. Pat. No. 5,957,678 discloses a combustion type detoxifying apparatus for the removal of raw gases such as silane comprised of a combustion chamber, a precombustion chamber located at the top of the combustion chamber and a multi-wall burner attached to the precombustion chamber. The multi-wall pipe type burner has: (1) a raw gas nozzle for injecting the feed gas, which is located at the center, (2) a lift gas nozzle for injecting a lift gas, which is arranged to surround the raw gas nozzle, (3) a feed gas combustion-assisting gas nozzle for injecting a gas for assisting combustion of combustible components in the feed gas (i.e., a first oxidant), which is arranged to surround the lift gas nozzle, (4) a fuel gas combustion-assisting gas nozzle for injecting a gas for assisting combustion of a fuel gas (i.e., a second oxidant), which is arranged to surround the residual gas combustion-assisting gas nozzle, and (5) a fuel gas nozzle for injecting the fuel gas, which is arranged to surround the fuel gas combustion-assisting gas nozzle.

The combustion chamber has a double wall structure containing a cylindrical outer barrel coupled with a fluid nozzle, a porous inner barrel having a constitution such that powders may be prevented from depositing on the inner surface of the inner barrel. If powdery solid oxides are formed during combustion treatment of the raw waste gas, such powders are prevented from being deposited on the inner surface of the inner barrel and interfering with the combustion treatment by passing a pressure fluid through the nozzle in the outer barrel. Thus, the combustion treatment can be carried out in a stable state over an extended period.

U.S. Pat. No. 4,801,437 discloses a process for combusting poisonous and solid forming gases such as silane, dichlorosilane, germane, etc., wherein combustible exhaust gases and an inert gas, primary and secondary air are downwardly fed through a coaxial, fourfold pipe burner provided with an innermost combustible exhaust gas path, and inert gas path, a primary air path and an outermost secondary air path to form downward flames for combustion. Downward flow is alleged to reduce the amount of deposition of fine dust such as silicon dioxide resulting from combustion on the burner nozzle.

U.S. Pat. No. 5,123,836 discloses the combustion treatment of a toxic gas which forms microparticles on combustion. The toxic feed gas is combusted and the combustion gas brought into contact with an aqueous film flowing downward on the inner wall of a furnace from the upper end to the lower end. The water captures the microparticles formed on combustion.

BRIEF SUMMARY OF THE INVENTION

This invention is directed to a combustion apparatus incorporating a combustion chamber, a precombustion chamber and a multi-wall burner and a process for effecting combustion of gases, particularly feed gases containing gases that, on combustion, form solid oxidation products, i.e., solid-forming gases.

The combustion apparatus comprises:

- a combustion chamber having an entrance to an interior portion and an exit therefrom;
- a precombustion chamber having an entrance and an exit with the exit in communication with the entrance of said combustion chamber;
- a multi-wall burner having at least one nozzle for injecting a feed gas containing a gas capable of forming solid phase oxidation products, at least one lift gas nozzle for injecting a lift gas, and at least one oxidant nozzle for injecting an oxidant; the respective nozzles directed for injecting into the entrance of said precombustion chamber; and,
- a pathway, formed between the exterior of the precombustion chamber; and the interior of said combustion chamber, whereby said pathway permits the introduction of a secondary oxidant into the interior portion of the combustion chamber.

Significant advantages can be achieved by effecting combustion of solid forming gases in the apparatus described herein and these include:

- an ability to effect combustion of solid forming gases which form solid phase oxidation products with a reduced incidence of burner nozzle plugging, even at high solid forming gas concentration;
- an ability to effect complete combustion of solid forming gases that form solids, such as silane, upon reaction with an oxidant with minimal to essentially no multi-wall burner and combustion chamber buildup;

an ability to minimize slippage of uncombusted solid forming gas and combustible solid intermediates to downstream parts of the system such as filter bags;

an ability to process diluted feed gas such as cylinder purge gas with stable flame and minimal slippage of uncombusted gases or intermediates;

an ability to operate at high turn-down ratio having stable combustion at high and low feed gas flow rates; and, an ability to separately control the first oxidant injected into the precombustion chamber and the secondary oxidant for process optimization and solids transport to post-combustion collection or processing steps.

DETAILED DESCRIPTION OF THE INVENTION

Figure 1:
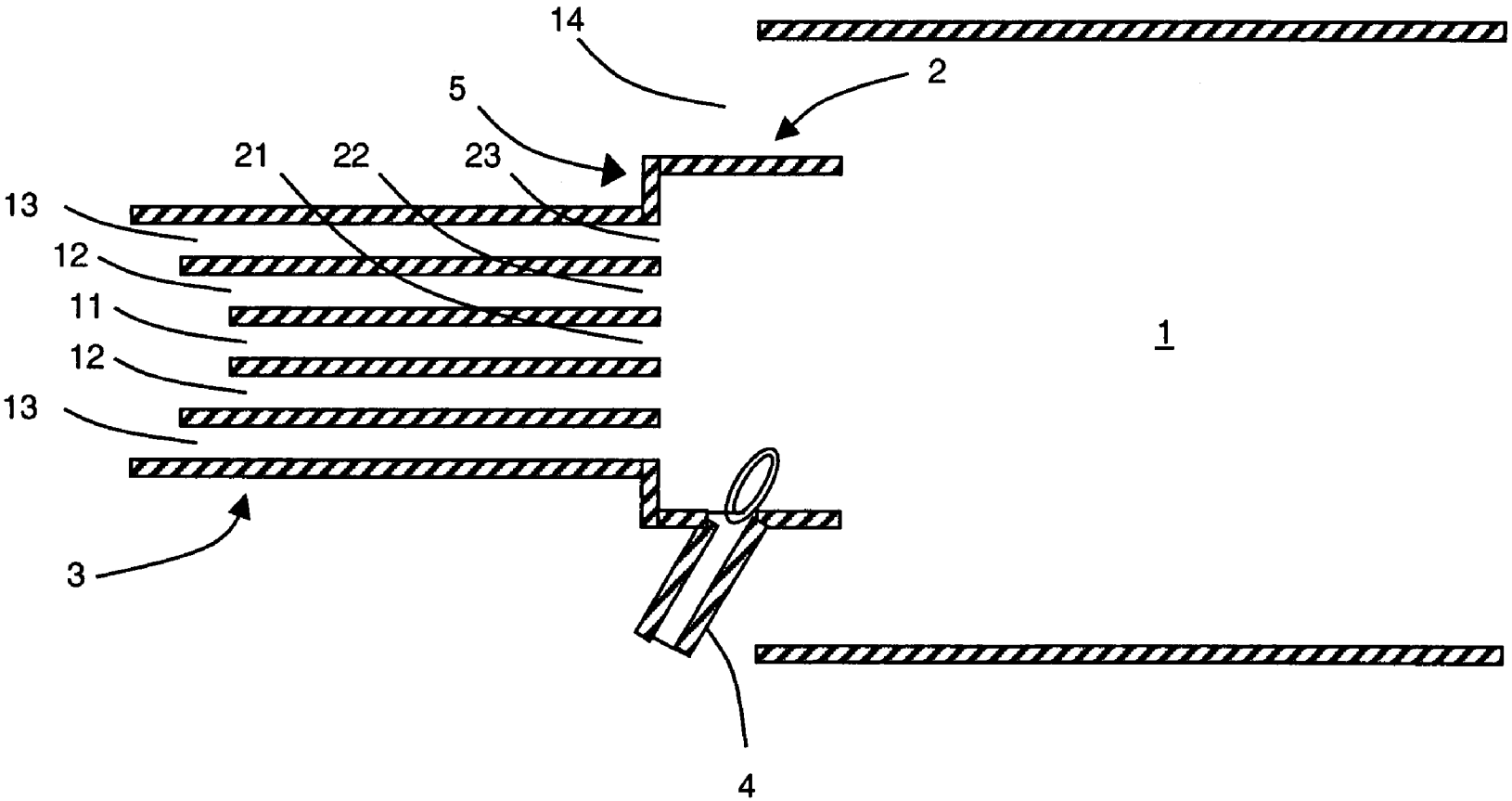
FIG. 1 is a view in cross section of a combustion apparatus showing a multi-wall burner discharging into the entrance of a precombustion chamber and then into the interior portion of a combustion chamber wherein the precombustion chamber resides partially within the combustion chamber.
Figure 2:
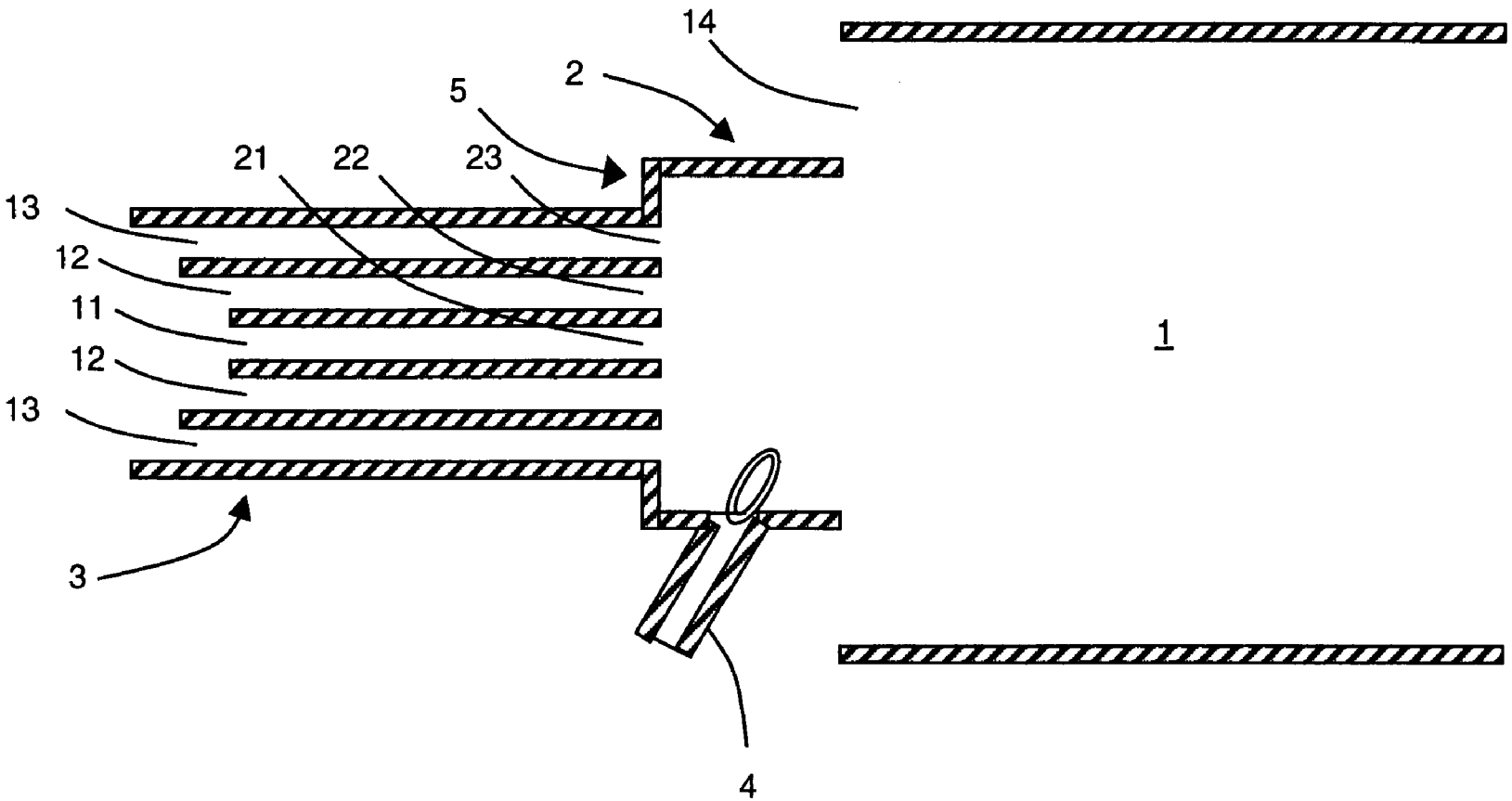
FIG. 2 is a view in cross section of a combustion apparatus showing a multi-wall burner discharging into a precombustion chamber and then into the combustion chamber wherein the precombustion chamber exit is flush with the opening of the combustion chamber.
Figure 3:
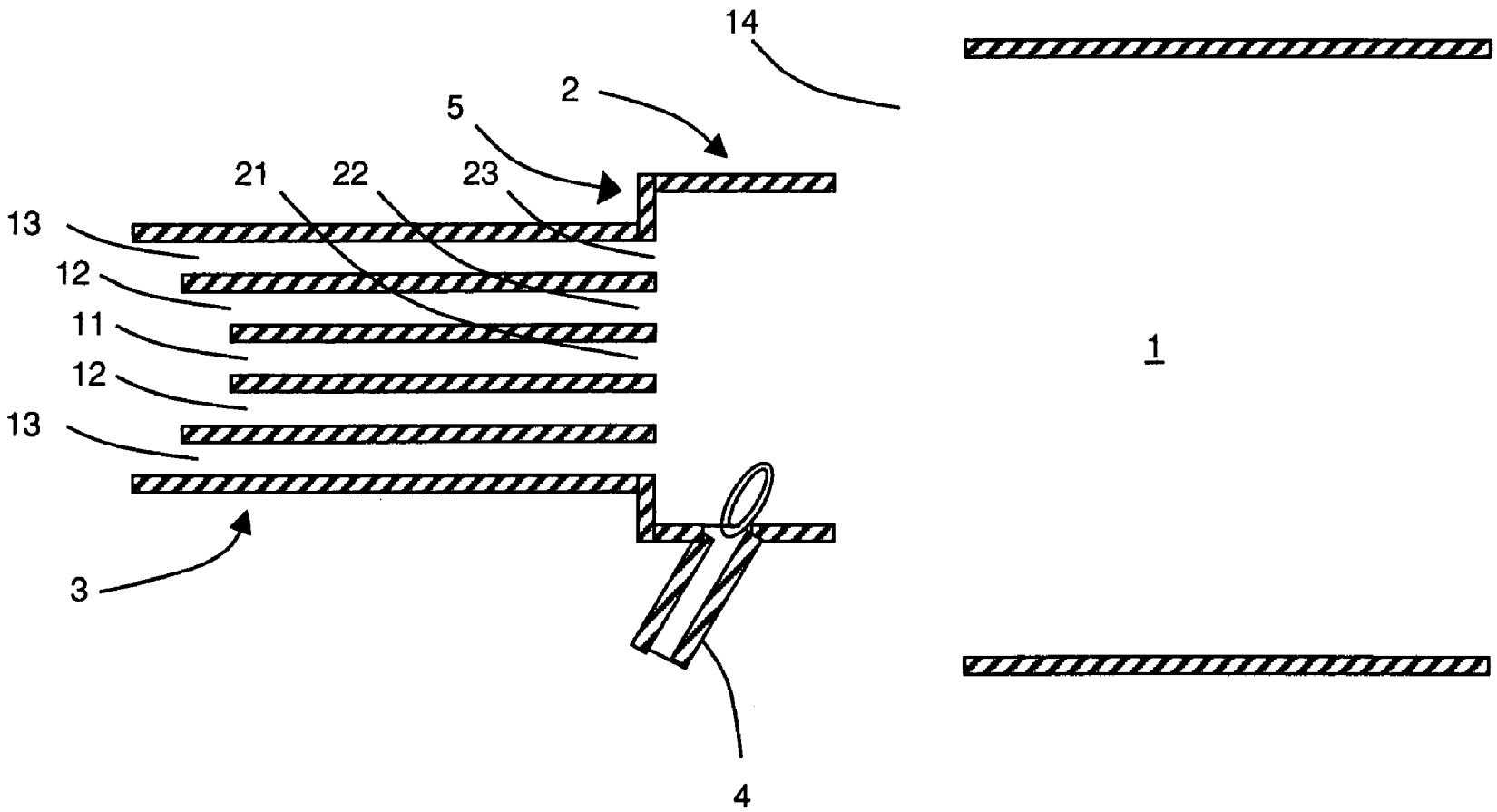
FIG. 3 is a view in cross section of a combustion apparatus showing a multi-wall burner discharging into a precombustion chamber and then into the combustion chamber wherein the exit of the precombustion chamber is outside of the entrance to the combustion chamber.
Figure 4:
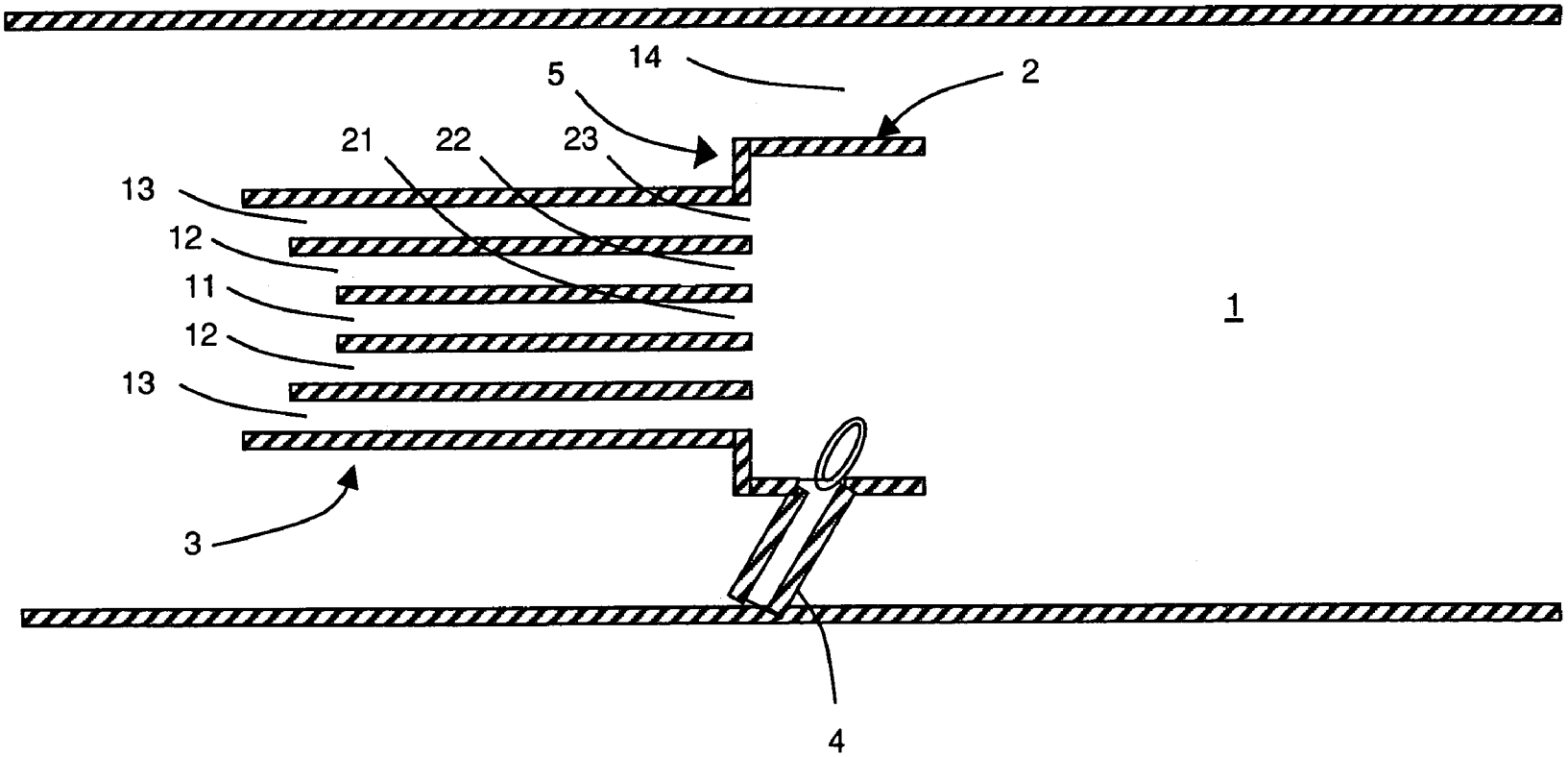
FIG. 4 is a view in cross section of a combustion apparatus showing a multi-wall burner discharging into a precombustion chamber and then into the combustion chamber wherein the burner and precombustion chamber resides entirely in a housing forming the combustion chamber.

This invention is directed to a combustion apparatus incorporating a combustion chamber, a precombustion chamber and a multi-wall burner and a process for effecting combustion of gases, particularly feed gases containing gases that form solid oxidation products in said combustion apparatus.

To facilitate an understanding of the combustion apparatus suited for effecting combustion of the gases, reference is made to the figures. (Identical numbers have been used in the figures to represent identical parts in the apparatus.)

In the figures, a combustion chamber 1 is designed for carrying out combustion of solid forming gases in a feed gas, which upon oxidation, form solid phase oxidation products. Such feed gases may be generated as waste gases from industrial processes or such gases may be employed as reactants in chemical processes. Solid forming gases flow from an entrance to an interior portion of the combustion chamber to an exit whereby a combustion product including finely divided solid phase particles are exhausted. The combustion chamber can be single or multi-walled, with an interior surface designed to inhibit deposition or buildup of solid phase particles on the surface. The combustion chamber can be insulated or uninsulated.

Adjacent to combustion chamber 1 is a precombustion chamber 2. The precombustion chamber has an entrance and an exit and is disposed at the outlet (nozzle) end of multi-wall burner 3. The precombustion chamber is used to effect at least partial combustion of the solid forming gas and prevent recirculation of the solid oxidation products of combustion back to the nozzles of multi-wall burner 3 and accumulating thereon. The precombustion chamber 2 preferably is generally circular and has about the same inner diameter as the inner diameter of the outermost wall of multi-wall burner 3, as in FIG. 5, so that there is no "step" between the burner and precombustion chamber. However, the precombustion chamber can have an inner diameter larger than the inner diameter of the outermost wall of multi-wall burner 3, i.e., step 5, as shown in FIGS. 1–4. Preferably, the ratio of the inner diameter of precombustion chamber 2 to that of the outermost wall of the multi-wall burner 3 is from 1 and 1.5. The length to diameter ratio (L/d) of the precombustion chamber 2 generally is from about 0.3 to 8 where the diameter is the diameter of the precombustion chamber 2. In a preferred embodiment, the L/d of the precombustion chamber is from about 0.75 to 3.5. (The precombustion chamber length is defined between the furthest extending nozzle of multi-wall burner 3 and the exit plane of the precombustion chamber.)

The gases, including solid particles, pass from the entrance of precombustion chamber 2, through precombustion chamber 2, and then, from its exit to the entrance of combustion chamber 1 and thereby into the interior portion of the combustion chamber 1. The precombustion chamber extends beyond the nozzles of multi-wall burner 3 forming a bounded space wherein the combustion reaction can be initiated but only a small fraction of the reaction occurs.

The multi-wall burner 3 has at least one passageway 11 terminating in nozzle 21 for injecting a feed gas that contains a solid-forming gas, at least one lift gas passageway 12 terminating in nozzle 22 for injecting a lift gas, and at least one passageway 13 terminating in nozzle 23 for injecting an oxidant for assisting combustion of the feed gas (and, if applicable, the lift gas) into the precombustion chamber. Nozzle 21 for introducing the feed gas is generally centrally located in the multi-wall burner. Surrounding nozzle 21 is lift gas nozzle 22, which provides for the introduction of a lift gas. Further, there is nozzle 23 for providing an oxidant, typically an oxygen source such as air. Normally, the multi-wall burner 3 is constructed of pipes having transverse cross-sections that are generally circular. The nozzle openings for the lift gas nozzle 22 and the oxidant nozzle 23, then, are generally in the form of an annulus.

To facilitate ignition of the solid forming gases, an ignition source, illustrated as a pilot burner 4, is employed in precombustion chamber 2. In the design represented in the figures, the flame (reaction zone) is detached from nozzle 21 so as to impede build up of solid products on the tip of nozzle 21, as well as other nozzles in the multi-wall burner 3. The pilot burner 4 when mounted in the precombustion chamber anchors the flame.

A UV flame detector (not shown) can optionally be employed downstream of the precombustion chamber in order to detect the existence of combustion, and, if combustion is not detected, the operation can be shut down by suitable controllers. Shutdown can be important to prevent slippage of the combustible gases to downstream equipment, such as filters, which are not suited for combustion.

An improvement in the combustion apparatus for reducing the deposition of solid phase combustion products on the nozzles, and particularly nozzle 21, resides in the establishment of pathway 14 between the exterior or outer wall of precombustion chamber 2 and the wall bounding or delineating the interior portion of combustion chamber 1. In most cases, combustion chamber 1 is open at the entrance for receiving partially combusted solid forming gases from the precombustion chamber and, thus, the pathway 14 is formed by the space between the exterior or outer wall of precombustion chamber 2 and the interior wall surface establishing the interior portion of combustion chamber 1. In this way, a second oxidant (oxidant) can be introduced through pathway 14 and directly into the interior portion of combustion chamber 1.

In operation, a feed gas containing a solid-forming gas is passed through passageway 11 to nozzle 21, which is centrally located within multi-wall burner 3. Illustrative of such solid-forming gases, which include highly toxic gases employed in the electronics industry, include gaseous compounds of Groups III to V metals of the Periodic Table such as arsine, phosphine, diborane, selenium hydride, silane, germane, chlorosilane, trimethylgallium, trimethylindium, and trimethylaluminum. Some of the solid phase oxidation products include arsenic oxide ($As_2O_3$, $AsO_5$) from arsine, phosphorus pentoxide ($P_2O_5$) from phosphine, and silicon oxides ($SiO$, $SiO_2$) from silanes. The velocity of the feed gas through nozzle 21 is at a rate to achieve desired combustion rates but less than 600 ft/s, more preferably less than 150, ft/s and most preferably less than 100 ft/s, e.g., 5 to 100 ft/sec. Feed gas streams containing solid forming gases may be diluted with nitrogen, helium, argon, natural gas, or other non-oxidizing gas, but the apparatus is well-suited for combusting highly concentrated and essentially pure solid-forming gases as the feed gas.

A lift gas is introduced through passageway 12 to lift gas nozzle 22 to prevent reaction of the solid-forming gas with an oxidant-containing gas at the exit of nozzle 21. Should reaction occur at the tip of the nozzle 21, there may be formation of solid particles that could build up at the tip of nozzle 21 and cause plugging. The lift gas is preferably a combustible gas that does not form solid phase oxidation products, such as hydrogen and hydrocarbons including natural gas, methane, ethane, propane, butane and the like, or mixtures thereof. The lift gas can also be an inert gas such as nitrogen, helium, or argon or mixtures thereof. Alternatively, the lift gas can be a mixture containing one or more combustible gases and inert gases.

For safety reasons, it is preferred that the lift gas is one that is combustible. Such combustion tends to facilitate combustion of the solid-forming gas injected from nozzle 21. Combustion can be established in the combustion chamber and detected by the optional UV detector (not shown) before the feed gas is introduced through the burner. In the absence of combustion of the lift gas, the apparatus is shut down. Not only does a combustible lift gas facilitate combustion, it serves, as does an inert gas, to prevent flash-back of a flame in nozzle 21. The nozzle velocity of the lift gas from nozzle 22 is less than 600 ft/s, more preferably between approximately 5 and 100 ft/s and most preferably between approximately 20 and 40 ft/s.

A first oxidant gas is introduced through passageway 13 and then through nozzle 23 to facilitate at least partial combustion of the solid-forming gas exiting nozzle 21 and lift gas, if combustible, from nozzle 22. The first oxidant flow is selected to provide an oxidant layer between the combustion zone and the wall of precombustion chamber 2. This minimizes overheating of the precombustion chamber wall since the oxidant is cooling the wall and the flame does not impinge on the wall. The oxidant layer provided by the first oxidant also serves to prevent solid products of combustion from impinging and accumulating on the wall of the precombustion chamber 2. The nozzle velocity of the first oxidant from nozzle 23 less than 400 ft/s, more preferably between approximately 5 and 100 ft/s and most preferably between approximately 20 and 40 ft/s.

The first oxidant can contain oxygen, chlorine, fluorine, or sulfur. These oxidant gases may be essentially pure or diluted with an inert gas such as nitrogen, helium, and argon. The first oxidant stream is preferably air. However, if there is interest in producing special compositions of microparticles and nanoparticles, alternative oxidants may be used.

To minimize backmixing in the precombustion chamber it is preferred to have the ratio of first oxidant stream velocity to the velocity of the lift gas in the range between 0.3 and 3 and more preferably between 0.8 and 1.2.

In the current invention, the equivalence ratio of the lift gas, if combustible, and first oxidant stream is 0.25 to 4. In a preferred embodiment, the equivalence ratio of the lift gas, if combustible and the first oxidant is 0.5 to 2. In general terms, the equivalence ratio is defined as the fuel:oxidizer ratio divided by the fuel:oxidizer ratio corresponding to complete combustion. The latter ratio (fuel:oxidizer ratio corresponding to complete combustion) is often referred to as the stoichiometric fuel:oxidizer ratio. An equivalence ratio of 1 means that fuel and oxidant are provided in the theoretically correct or stoichiometric amount. An equivalence ratio greater than 1 is fuel rich and an equivalence ratio less than 1 is fuel lean.

A second oxidant is passed through pathway 14 located exterior of precombustion chamber 2 and introduced to the interior of combustion chamber 1. It is independent of the first oxidant stream. The second oxidant can contain oxygen, chlorine, fluorine, or sulfur. These oxidant gases may also be diluted with an inert gas such as nitrogen, helium, and argon. The second oxidant stream is preferably air.

The second oxidant is introduced though pathway 14 external to the precombustion chamber 2 and into the interior portion of combustion chamber 1. In a preferred embodiment, this second oxidant is introduced or drawn into the entrance of combustion chamber 1, and interior portion thereof, by a fan downstream of the combustion chamber (not shown). Other means known by those skilled in the art, such as an upstream fan and associated ductwork, or jet eductors, can force the second oxidant around precombustion chamber 2, through pathway 14, and into the interior portion of combustion chamber 1. The velocity of the second oxidant entering the combustion chamber 1 is generally less than 600 ft/s, more preferably between approximately 5 and 300 ft/s and most preferably between approximately 10 and 100 ft/s.

The second oxidant stream is provided in an amount exceeding the stoichiometric amount needed to completely combust the lift gas, if combustible, and the feed gas. The second oxidant stream can also act to cool the combustion products in the combustion chamber 1. The equivalence ratio of the solid forming gas 21 and second oxidant introduced through passageway 14 is generally less than 0.2.

After effecting combustion of the solid-forming gases, the solids generated within combustion chamber 1, flow from the exit thereof to a collection system such as a baghouse, electrostatic precipitator, or other solids collection system known in the art (not shown).

The following examples are provided to illustrate various embodiments of the invention are not intended to restrict the scope thereof.

EXAMPLE 1

Combustion Apparatus for the Disposal of Gases that Form Solid Phase Oxidation Products A burner according to this disclosure was manufactured and tested for the combustion of silane gas. The multi-wall burner nozzles had a circular cross section. Details of the apparatus and test conditions for combustion of silane are summarized in Table 1.

TABLE 1

| | |
|---|---|
| Feed Gas | Silane (undiluted) |
| Lift Gas | Methane |
| First Oxidant | Air |
| Second Oxidant In Pathway 14 | Air |
| Diameter Of Combustion Chamber 1 | Approximately 8 inches |
| Diameter Of Feed Gas Nozzle 21 | 0.277 inches |
| Inner Diameter Of Lift Gas Nozzle 22 | 0.375 inches |
| Outer Diameter Of Lift Gas Nozzle 22 | 0.495 inches |
| Inner Diameter Of First Oxidant Nozzle 23 | 0.625 inches |
| Outer Diameter Of First Oxidant Nozzle 23 | 1.26 inches |
| Inner Diameter Of Precombustion Chamber 2 | 1.76 inches |
| Precombustion Chamber Inner Diameter 2 To Outermost Nozzle Outer Diameter 23 Ratio | 1.4 |
| Precombustion Chamber Length To Diameter Ratio | 2.3 |
| Feed Gas Nozzle Velocity | 0 to 100 ft/s |
| Lift Gas Nozzle Velocity | Approximately 31 ft/s |
| First Oxidant Nozzle Velocity | Approximately 26 ft/s |
| Second Oxidant Inlet Velocity | Approximately 50 ft/s |
| First Oxidant To Lift Gas Velocity Ratio | 0.84 |
| Lift Gas And First Oxidant Equivalence Ratio | 1.009 |
| Feed Gas And Second Oxidant Equivalence Ratio | 0 to 0.0235 |

The multi-wall burner 3 of the pipe burner type was mounted to introduce the gases into precombustion chamber 2 and then from precombustion chamber 2 to combustion chamber 1. Combustion chamber 1 was an 8-inch diameter glass (quartz) pipe, which allowed the flame to be visually observed. A blower and associated metal ductwork was located downstream of the combustion chamber with the combustion gases exhausting into a manifold that fed multiple Nomex® filter bags.

The procedure was as follows. Initially, the blower at the downstream end of combustion chamber 1 was turned on in order to induce airflow through combustion chamber 1 and provide the secondary oxidant to facilitate combustion. Then, the first oxidant stream (air) was established in passageway 13. Fuel and air flows to the pilot burner 4 were established and the pilot burner was ignited. Flame detection by the pilot burner was confirmed before continuing. A lift gas flow, which was methane, (a gaseous fuel stream) was established in passageway 12 and a stable flame was established with the methane lift gas and first oxidant (air). A UV detector confirmed the existence of a flame with the lift gas and first oxidant stream. At this point, the feed gas, which was essentially pure silane, was started and the flow was increased in stepwise fashion up to 100 ft/s over a period of about 1.5 hours. After 1.5 hours operation, combustion was terminated and the multi-wall burner inspected. No blockage of any of the nozzles in multi-wall burner 3 was observed. Only, a very small amount of silica dust was found on the center tube and on the inner wall of the precombustion chamber.

EXAMPLE 2

Combustion Apparatus for the Disposal of Gases that Form Solid Phase Oxidation Products The apparatus of Example 2 was similar to that of Example 1 with minor modifications to the apparatus and operating conditions. Specifically, the inner diameter of the precombustion chamber, the ratio of the inner diameter of the precombustion chamber to the outermost nozzle diameter was reduced (substantially equal as in FIG. 5). The precombustion chamber length was the same as in Example 1 resulting in an increase in the precombustion chamber length to diameter ratio. Details of the apparatus and test conditions are summarized in Table 2.

TABLE 2

| | |
|---|---|
| Feed Gas | Silane (undiluted) |
| Lift Gas | Methane |
| First Oxidant | Air |
| Second Oxidant In Pathway 14 | Air |
| Diameter Of Combustion Chamber 1 | Approximately 8 inches |
| Diameter Of Feed Gas Nozzle 21 | 0.277 inches |
| Inner Diameter Of Lift Gas Nozzle 22 | 0.375 inches |
| Outer Diameter Of Lift Gas Nozzle 22 | 0.495 inches |
| Inner Diameter Of First Oxidant Nozzle 23 | 0.625 inches |
| Outer Diameter Of First Oxidant Nozzle 23 | 1.26 inches |
| Inner Diameter Of Precombustion Chamber 2 | 1.26 inches |
| Precombustion Chamber Inner Diameter 2 To Outermost Nozzle Outer Diameter 23 Ratio | 1.0 |
| Precombustion Chamber Length To Diameter Ratio | 3.2 |
| Feed Gas Nozzle Velocity | 0 to 100 ft/s |
| Lift Gas Nozzle Velocity | Approximately 31 ft/s |
| First Oxidant Nozzle Velocity | Approximately 26 ft/s |
| Second Oxidant Inlet Velocity | Approximately 50 ft/s |
| First Oxidant To Lift Gas Velocity Ratio | 0.84 |
| Lift Gas And First Oxidant Equivalence Ratio | 1.009 |
| Feed Gas And Second Oxidant Equivalence Ratio | 0 to 0.0235 |

The test configuration was the same as Example 1 with the multi-wall burner, precombustion chamber and operating parameters as given in Table 2. The same procedure for establishing a stable flame with the methane lift gas and first oxidant (air) before introduction of silane was followed.

The silane velocity was maintained at about 80 ft/s for 45 minutes. Subsequently, the burner was inspected and no silica dust was found on the nozzles and only minimal dusting was found on the precombustion chamber.

Figure 5:
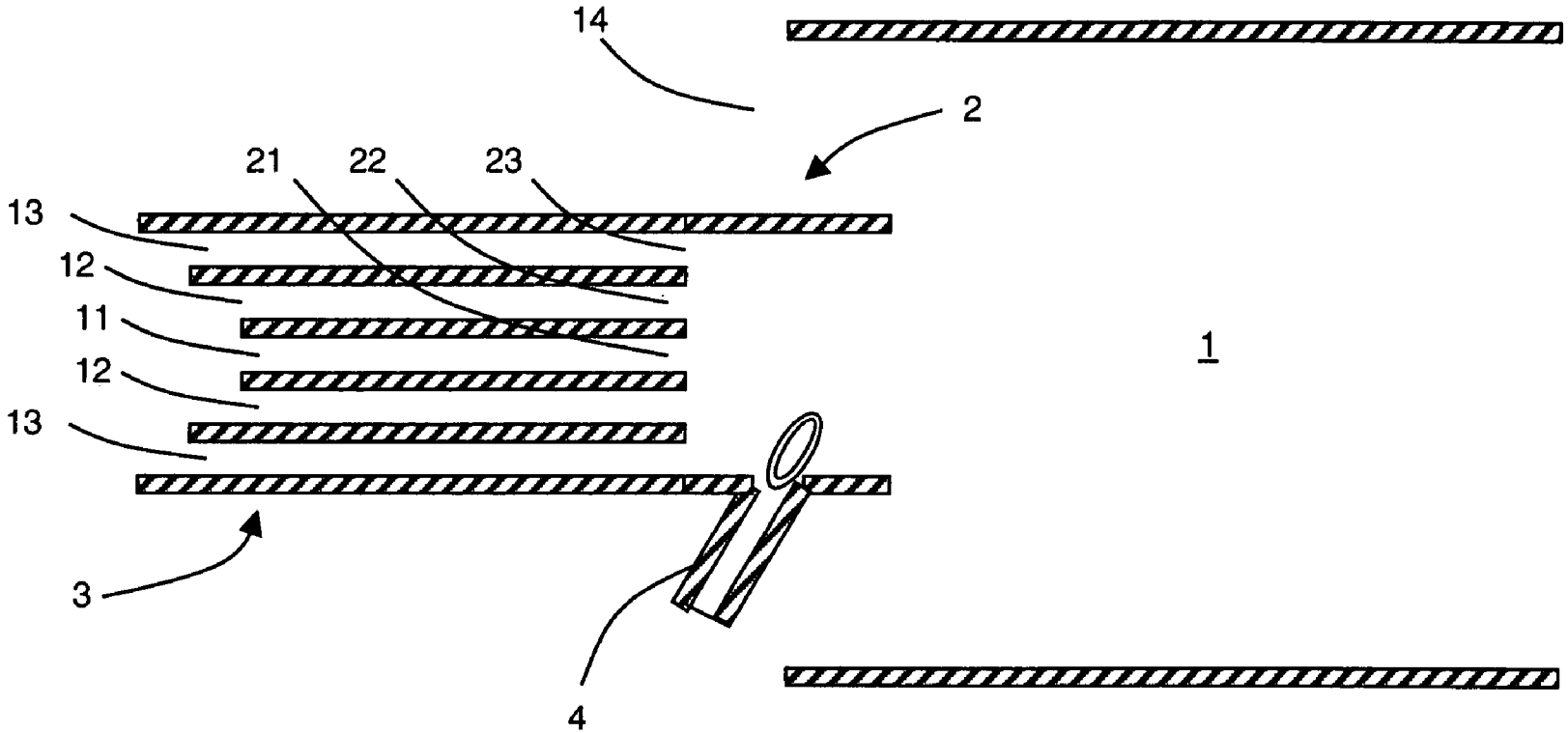
FIG. 5 is a view in cross section of a combustion apparatus showing a multi-wall burner discharging into a precombustion chamber and then into the combustion chamber wherein the precombustion chamber resides partially within the combustion chamber. In contrast to the precombustion chambers described in FIGS. 1–4 where the transverse cross-sectional area of the precombustion chamber is greater than the transverse cross-sectional area formed by the outer edge of the outermost nozzle (i.e. there is a step between the precombustion chamber and the outermost nozzle), in FIG. 5 the transverse cross-sectional area of the precombustion chamber is the same as the transverse cross-sectional area formed by the outer edge of the outermost nozzle (i.e., there is no step).

A 60 minute test with the same parameters in Table 2 with the exception that the first oxidant stream nozzle velocity was increased to 38 ft/s (first oxidant stream to gaseous fuel stream velocity ratio of 1.2) provided a result where no silica dust was found on the nozzles or the precombustion chamber. From this it was concluded that the reduced precombustion chamber diameter to outermost nozzle wall ratio, as shown in FIG. 5, was favored.

After all of the tests, particle samples were collected from the filter bags. The particles produced ranged in size from 80 to 320 nm as determined from scanning electron microscopy.

EXAMPLE 3

Combustion of Silane at Transfill Facility Variable Flow of First Oxidant, Gas, and Feed Gas The construct of the apparatus at a transfill facility was similar to the apparatus at the trial described in Example 2. However, the filter bags were place between the combustion chamber and the induced draft fan. Also the combustion chamber was made of stainless steel instead of glass. The nozzle tips of the burner were rounded to help further minimize build up of particles on the nozzle tips.

In contrast, to Example 2 where the velocity of the silane feed gas was generally held constant, operation at a transfill facility requires that the silane flow be turned on and off thereby resulting in variable silane feed gas nozzle velocities from 0 to 100 ft/sec as the cylinders are emptied. In addition, there are (mainly downstream) pressure fluctuations in the system that affect the flows in the precombustion chamber.

The test showed there was greater build up of particles in the precombustion chamber wall than in Example 2. It is concluded that the process variability caused some backmixing in the precombustion chamber as opposed to a more plug flow vis-à-vis the flows established Example 2.

In an effort to reduce build up, the precombustion chamber length was shortened to provide a precombustion chamber length to diameter ratio of approximately 1.6. This action appeared to have solved the problem

EXAMPLE 4

Combustion of Silane with Higher Flow of First Oxidant

A test was run in accordance with Example 2 except the velocity of the first oxidant was increased by 50%, i.e., to about 39 ft/sec. The higher flow rate of the first oxidant, relative to the velocity of the lift gas, i.e., 26 ft/sec, resulted in a greater accumulation of the solid particles on the precombustion chamber and nozzle than in Examples 1 and 2. It is believed that the unequal and higher velocity of the first oxidant to that of the lift gas directed combustion inwardly creating backmixing instead of plug flow thus contributing to build up.

Results for the case where essentially all of the oxidant necessary for effecting combustion is introduced through the precombustion chamber can only be hypothesized. However, by extrapolating the above results for the higher flow rate of first oxidant to that of the lift gas, an even higher oxidation flow rate would be expected to create even greater turbulence inside the precombustion chamber. This increased level of turbulence would more than likely cause backmixing of the first oxidant and the silane inside the precombustion chamber and cause particles to build up on the precombustion chamber wall.

Summarizing, the results of little deposition of silane oxidation products on the multi-wall burner nozzles and precombustion chamber was unexpected given the high concentration of the solid forming gas and concentration of oxidation products. Through the introduction of significant levels of secondary oxidant into the combustion chamber via pathway 14, further, and essentially complete, combustion is effected with minimal backmixing of the respective gas flows through the multi-wall burner. By establishing careful control of the gas flows through the multi-wall burner and secondary oxidant flow through pathway 14 such that there is essentially plug flow through the apparatus one can eliminate or substantially reduce particle deposition in the combustion apparatus. In addition, it is not necessary to dilute the solid forming feed gas with an inert gas in order to minimize particle build up. Highly concentrated streams, e.g., essentially pure feed streams of solid forming gas may be processed in the apparatus.

What is claimed is:

1. In a combustion apparatus comprising:

a combustion chamber having an entrance to an interior portion and an exit therefrom;

a precombustion chamber having an entrance and an exit with the exit in communication with the entrance of said combustion chamber;

a multi-wall burner having at least one nozzle for injecting a feed gas containing a gas capable of forming solid phase oxidation products, at least one lift gas nozzle for injecting a lift gas, and at least one oxidant nozzle for injecting an oxidant; the respective nozzles directed for injecting into the entrance of said precombustion chamber; the improvement which comprises:

a pathway, formed between the exterior of the precombustion chamber and the interior portion of said combustion chamber, whereby said pathway permits the introduction of a secondary oxidant exterior to the precombustion chamber and into the interior portion of the combustion chamber.

2. The combustion apparatus of claim 1 wherein said lift gas passageway surrounds said feed gas nozzle.

3. The apparatus of claim 2 wherein said oxidant nozzle surrounds said lift gas nozzle.

4. The apparatus of claim 3 wherein the multi-wall burner is a pipe burner.

5. The apparatus of claim 4 wherein a constant ignition source is provided in said precombustion chamber.

6. The apparatus of claim 4 wherein the length to diameter ratio of the precombustion chamber is from 0.3 to 8.

7. The apparatus of claim 6, wherein the length to diameter ratio of the precombustion chamber is 0.75 to 3.5.

8. A process for the combustion treatment of a feed gas containing a solid forming gas that forms solid phase oxidation products on combustion, which comprises:

injecting said feed gas containing said solid-forming gas into a precombustion chamber through a first nozzle;

injecting an oxidant into said precombustion chamber through a second nozzle;

injecting a lift gas into said precombustion chamber through a third nozzle disposed between said first nozzle and said second nozzle;

at least partially combusting said solid forming gas in said precombustion chamber;

exhausting the partially combusted gases generated in the precombustion chamber into an interior portion of a combustion chamber for effecting further combustion thereof; and, introducing a second oxidant into the interior portion of said combustion chamber through a pathway formed between the exterior of said precombustion chamber and interior portion of said combustion chamber.

9. The process of claim 8 wherein said solid-forming gas is a gaseous compound selected from the group consisting of a Groups III to V metal of the Periodic Table.

10. The process of claim 9 wherein the solid forming gas is selected from the group consisting of silane, arsine, phosphine, germane, diborane, selenium hydride, monosilane, chlorosilane, trimethylgallium, trimethylindium, and trimethylaluminum.

11. The process of claim 8 wherein the lift gas is selected from the group consisting of natural gas, hydrogen, methane, ethane, propane, and mixtures thereof.

12. The process of claim 8 wherein the velocity of the feed gas through the first nozzle is from 5 to 100 feet per second and the velocity of the lift gas though said second nozzle is from 5 to 100 feet per second.

13. The process of claim 12 wherein the equivalence ratio of the lift gas and first oxidant is from 0.5 to 2 and the ratio of the velocity of the first oxidant to the velocity of the lift gas is from 0.8 to 1.2.

14. A combustion apparatus comprising:

a multi-wall burner having a feed gas nozzle for injecting a feed gas containing a gas capable of forming solid phase oxidation products, a lift gas nozzle for injecting a lift gas, and a first oxidant nozzle for injecting a first oxidant, wherein said lift gas nozzle is disposed between said feed gas nozzle and said first oxidant nozzle, said multi-wall burner having an inlet end and a nozzle end;

a precombustion chamber with a first end attached to the nozzle end of said multi-wall burner and a second end adapted to expel said feed gas, said lift gas, and said first oxidant;

a combustion chamber having an opening adapted for receiving said feed gas, said lift gas, and said first oxidant from said precombustion chamber; and a means for introducing a second oxidant into said combustion chamber external to and generally around said precombustion chamber.

15. The apparatus of claim 14 wherein a constant ignition source is provided in said precombustion chamber.

16. The apparatus of claim 14 wherein the length to diameter ratio of the precombustion chamber is from 0.3 to 8.

17. The apparatus of claim 16, wherein the length to diameter ratio of the precombustion chamber is 0.75 to 3.5.

18. A process for the combustion treatment of a feed gas containing a solid forming gas that forms solid phase oxidation products on combustion, which comprises:

injecting said feed gas containing said solid-forming gas into a precombustion chamber through a first nozzle;

injecting an oxidant into said precombustion chamber through a second nozzle;

injecting a lift gas into said precombustion chamber through a third nozzle disposed between said first nozzle and said second nozzle;

at least partially combusting said solid forming gas in said precombustion chamber;

introducing the partially combusted gases generated in the precombustion chamber into a combustion chamber for effecting further combustion thereof; and, introducing a second oxidant into said combustion chamber through a pathway external to said precombustion chamber for combusting said solid forming gas.

19. The process of claim 18 wherein the solid forming gas is selected from the group consisting of silane, arsine, phosphine, germane, diborane, selenium hydride, monosilane, chlorosilane, trimethylgallium, trimethylindium, and trimethylaluminum.

20. The process of claim 18 wherein the lift gas comprises a combustible gas that does not form solid phase oxidation products and optionally an inert gas.

21. The process of claim 18 wherein the velocity of the feed gas through the first nozzle is from 5 to 100 feet per second and the velocity of the lift gas though said second nozzle is from 5 to 100 feet per second.

22. The process of claim 21 wherein the equivalence ratio of the lift gas and first oxidant is from 0.5 to 2 and the ratio of the velocity of the first oxidant to the velocity of the lift gas is from 0.8 to 1.2.

23. The process of claim 18 wherein the equivalence ratio of the feed gas and the second oxidant is less than 0.2.

* * * * *